US008925268B2

(12) United States Patent
Tourneur et al.

(10) Patent No.: US 8,925,268 B2
(45) Date of Patent: Jan. 6, 2015

(54) PROCESS FOR REINFORCING A CONSTRUCTION STRUCTURE, AND STRUCTURE THUS REINFORCED

(75) Inventors: Christian Tourneur, Le Mesnil Saint Denis (FR); Erik Mellier, Versailles (FR)

(73) Assignee: Soletanche Freyssinet, Rueil Malmaison (FR)

( * ) Notice: Subject to any disclaimer, the term of this patent is extended or adjusted under 35 U.S.C. 154(b) by 174 days.

(21) Appl. No.: 12/848,708

(22) Filed: Aug. 2, 2010

(65) Prior Publication Data

US 2011/0036029 A1 Feb. 17, 2011

(30) Foreign Application Priority Data

Aug. 3, 2009 (FR) ..... 09 55462

(51) Int. Cl.
*E04C 1/00* (2006.01)
*E04G 23/02* (2006.01)

(52) U.S. Cl.
CPC ..... *E04G 23/0218* (2013.01)
USPC ..... 52/309.1; 52/309.5

(58) Field of Classification Search
USPC ..... 52/309.1, 309.5, 293.2, 319, 600
See application file for complete search history.

(56) References Cited

U.S. PATENT DOCUMENTS

| | | | | |
|---|---|---|---|---|
| 5,937,606 | A * | 8/1999 | Meier et al. | 52/600 |
| 6,324,805 | B1 * | 12/2001 | Naniwa | 52/431 |
| 6,389,775 | B1 * | 5/2002 | Steiner et al. | 52/600 |
| 6,418,684 | B1 | 7/2002 | Morton | |
| 6,511,727 | B1 * | 1/2003 | Bleibler et al. | 428/50 |
| 6,605,168 | B1 * | 8/2003 | Bleibler et al. | 156/71 |
| 2009/0013625 | A1 | 1/2009 | Tourneur et al. | |

FOREIGN PATENT DOCUMENTS

| | | |
|---|---|---|
| EP | 1 186 730 | 3/2002 |
| EP | 1 331 327 | 7/2003 |
| EP | 1 881 125 | 1/2008 |
| FR | 2 918 689 | 1/2009 |

* cited by examiner

*Primary Examiner* — Basil Katcheves
(74) *Attorney, Agent, or Firm* — McKenna Long & Aldridge LLP

(57) ABSTRACT

Process for reinforcing a construction structure where, laid on one portion of said structure, is at least one portion of a reinforcement (10) of elongated shape comprising continuous fibers in the longitudinal direction of said reinforcement, which are combined with a polymer matrix, wherein said process comprises a step of removing the polymer matrix in one portion (20) of the reinforcement so as to release the fibers of the reinforcement in order to allow their rearrangement following their release from the polymer matrix. It is thus possible to optimize the binding configuration of the reinforcement with a portion of the structure to be reinforced.

7 Claims, 4 Drawing Sheets

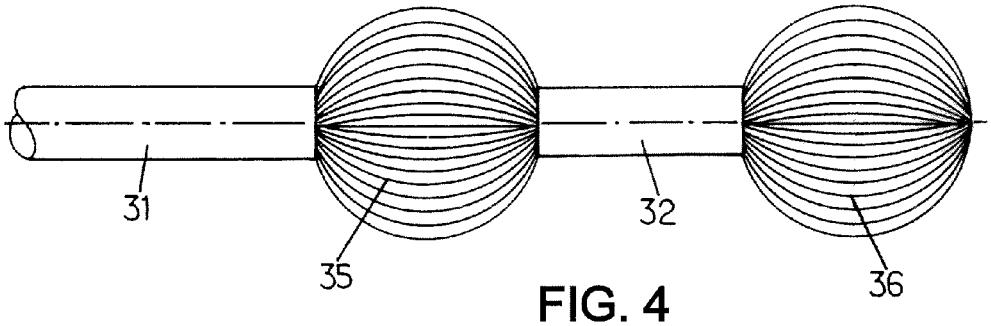
FIG. 4
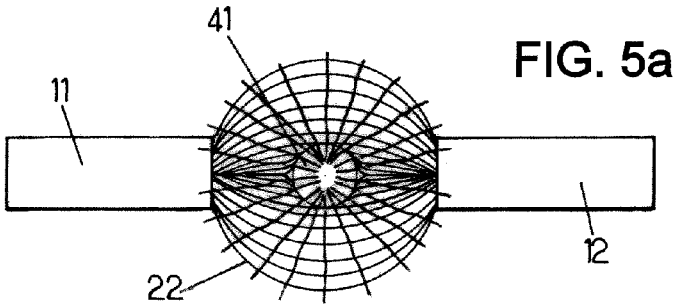
FIG. 5a
FIG. 5b
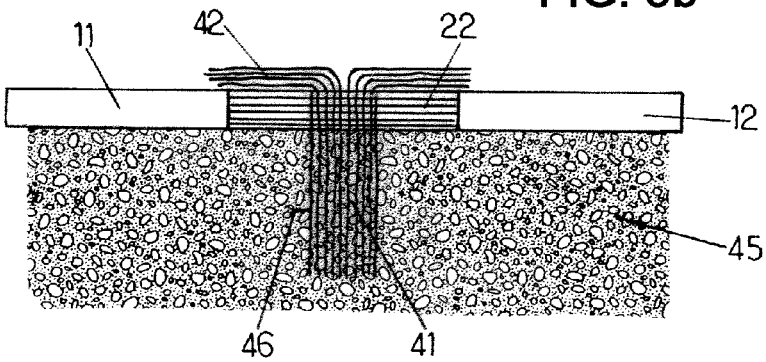

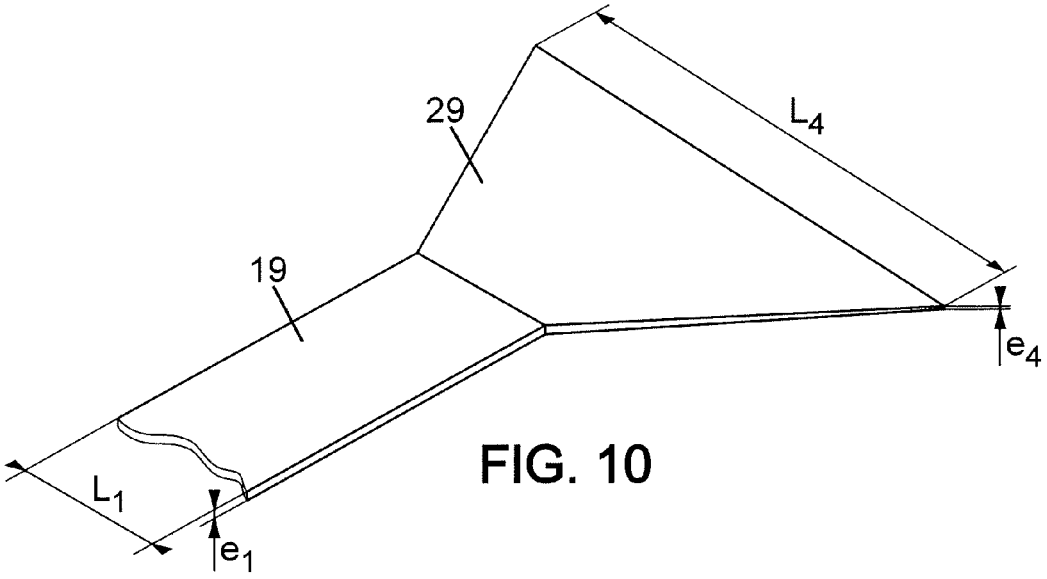
FIG. 10
FIG. 11
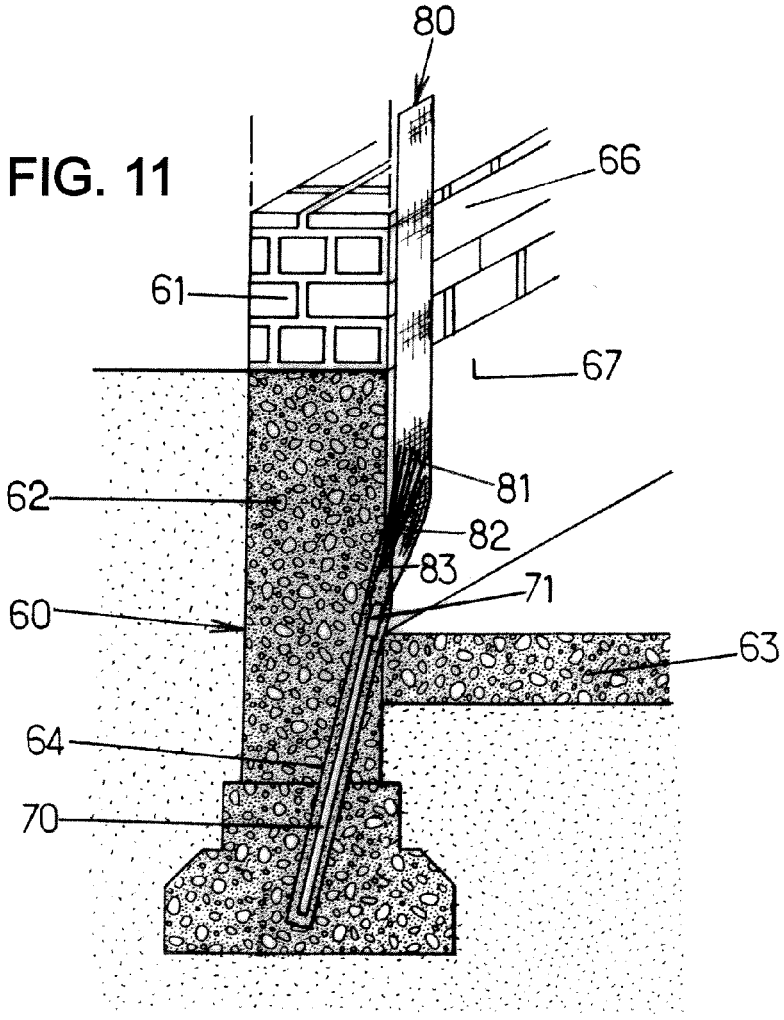

PROCESS FOR REINFORCING A CONSTRUCTION STRUCTURE, AND STRUCTURE THUS REINFORCED

This application claims priority to French Application No. 09 55462, filed on Aug. 3, 2009 in France, the contents of which is hereby incorporated by reference in its entirety as if fully set forth herein.

FIELD OF THE INVENTION

The present invention relates to the field of reinforcing construction structures.

In this field, it is customary to bond reinforcements by means of suitable resins to portions of a structure to be reinforced.

BACKGROUND OF THE INVENTION

Initially made of metal sheets, such as used in the Lhermite process, these reinforcements have seen their composition evolve in the last few decades following the appearance of replacement materials for metal sheets. Reinforcements based on composites in the form of bonded plates (see, for example, document FR-A-2594871) or bonded fabrics (see, for example, document EP 0 799 951) are now commonly used.

Reinforcements based on composites have many advantages, in particular linked to their ease of use and to their ability to be applied to various surfaces. They improve, for example, very substantially, the dynamic behavior of the reinforced structure.

Use may advantageously be made of reinforcements of elongated shape comprising continuous fibers combined with a polymer matrix, manufactured for example by pultrusion or by extrusion and the cross section of which is substantially constant along a longitudinal direction. These reinforcements of elongated shape may advantageously be in lamellar form so as to provide a broad bonding surface area. These reinforcements are, for example, positioned on a face in tension of a structural element made of reinforced or prestressed concrete so as to enable a reinforcement in tension. These reinforcements may also have the shape of long cylinders commonly known as rods.

An example of a reinforcement in lamellar form is sold by the company Freyssinet under the commercial reference FOREVA® LFC.

By way of example, such elongated reinforcements in lamellar form may have a width of 50, 80, 100 or 150 mm and a thickness of 1.2 mm.

Still by way of example, reinforcements of elongated shape are constituted of carbon fibers impregnated by an epoxy matrix. Such reinforcements may be manufactured by pultrusion or by extrusion.

Such reinforcements of elongated shape, although very commonly used for reinforcing construction structures, nevertheless have certain drawbacks. In particular, it is observed that it is difficult to optimize the binding configuration of such reinforcements with a portion of the structure to be reinforced.

SUMMARY OF THE INVENTION

The objective of the present invention is to propose a process for reinforcing a construction structure using such a reinforcement of elongated shape while making it possible to optimize the binding configuration with a portion of the structure to be reinforced.

The invention thus proposes a process for reinforcing a construction structure where, laid on one portion of said structure, is at least one portion of a reinforcement of elongated shape comprising continuous fibers in the longitudinal direction of said reinforcement, which are combined with a polymer matrix, where said process comprises a step of removing the polymer matrix in one portion of the reinforcement so as to release the fibers of the reinforcement in order to allow the rearrangement thereof following their release from the polymer matrix.

It is thus possible to use a reinforcement of elongated shape produced in a standard manner, the cost of which is advantageous, while rearranging some of the fibers which constitute it so as to optimize the binding configuration of the reinforcement with a portion of the structure to be reinforced. It is thus possible to take into account, for example, geometric variations of the structure and to preferentially reinforce certain zones of the structure, to distribute stresses between the reinforcement and certain zones of the structure in a controlled manner.

The expression "reinforcement of elongated shape" is understood to mean a reinforcement that extends along a longitudinal direction.

In general, but not necessarily, the cross section perpendicular to the longitudinal axis of said reinforcement is substantially constant over the entire length of said reinforcement.

According to various embodiments, the reinforcement of elongated shape is chosen from a reinforcement in lamellar form, a reinforcement in rod form, a pultruded elongated reinforcement, an extruded elongated reinforcement.

The expression "reinforcement in lamellar form" is understood to mean a reinforcement that extends along a longitudinal direction and the cross section of which, perpendicular to said longitudinal direction, has an elongated shape, with one dimension, designated the width, significantly greater than the other dimension, designated the thickness. By way of example, the width is greater than or equal to ten times the thickness, for example greater than or equal to twenty times the thickness, or even greater than or equal to forty times the thickness.

By way of example, the thickness of such a reinforcement in lamellar form is greater than or equal to 0.5 mm, for example greater than or equal to 1 mm, in particular less than or equal to 5 mm. By way of example, the width of such a reinforcement is greater than or equal to 10 mm, for example greater than or equal to 50 mm and in general less than or equal to 500 mm, or even less than or equal to 200 mm.

By way of example, the length of such a reinforcement is greater than or equal to ten times its width; in particular it is greater than or equal to one meter and measures, for example, several meters.

The term "rod" is understood to mean a reinforcement of elongated shape, the cross section of which, perpendicular to the longitudinal direction, has the shape of a circle or of an ellipse. The largest dimension of this cross section is, for example, between 1 cm and 10 cm.

The cross section of elongated shape of a reinforcement of elongated shape is, for example, substantially constant over the entire length of the reinforcement.

A reinforcement of elongated shape is, in general, a straight reinforcement. It is also possible for the reinforcement of elongated shape to be curved or arched in the longitudinal direction, in general with a large radius of curvature. It is also possible to envision reinforcements of elongated shape with sinuosities in the longitudinal direction, provided, for example, in order to adapt to the geometry of a portion of the structure to be reinforced.

The reinforcement of elongated shape comprises continuous fibers, in general in continuity of material over the whole of the length of the reinforcement, combined with a polymer matrix.

Numerous fibers may be used for manufacturing such reinforcements such as, non-limitingly, carbon fibers, mineral fibers, such as for example glass fibers or basalt fibers, polymer fibers such as for example aramid fibers (known, for example, under the trade name KEVLAR®).

The fibers are generally positioned unidirectionally in the longitudinal direction of the reinforcement. It is also possible to manufacture reinforcements of elongated shape with fibers arranged in the form of woven fabrics, where a portion of the fibers is positioned in the longitudinal direction of the reinforcement and the other portion in a transverse direction.

The polymer matrix may be essentially constituted of a thermosetting polymer, such as for example an epoxy resin, or of a thermoplastic polymer.

Preferably, such a reinforcement is obtained by industrial techniques of composite production, such as for example pultrusion, extrusion or molding.

According to one embodiment, the polymer matrix is essentially constituted of a thermosetting polymer and the removal thereof is obtained by pyrolysis. The temperature conditions of the pyrolysis are determined so as to remove the thermosetting polymer while preserving the fibers, and especially their mechanical properties.

By way of example, the fibers are carbon fibers and the pyrolysis temperature is between 800° C. and 1500° C. The pyrolysis may be obtained, for example, by placing the portion of the reinforcement, where it is desired to remove the polymer matrix, in a furnace brought to the desired temperature, or according to another embodiment by directing a blowpipe toward this portion of the reinforcement.

According to one embodiment, a portion of the reinforcement of elongated shape is cooled so as to limit the heat transfer due to the pyrolysis. Such cooling may, for example, be obtained by clamping a portion of the reinforcement of elongated shape in a cooled part or by spraying with a cold gas.

According to another embodiment, the step of removing the polymer matrix is obtained by selective chemical dissolution of the matrix.

According to various embodiments which may be combined together in accordance with all the combinations that can be envisioned:

- a portion of the reinforcement where the polymer matrix has been removed is positioned at one end of said reinforcement;
- a portion of the reinforcement where the polymer matrix has been removed is positioned between the ends of said reinforcement;
- the rearrangement of the fibers released from the polymer matrix consists in positioning and bonding these fibers to a portion of the structure to be reinforced; the fibers may then be positioned over the structure in all the desired directions and distributed judiciously in order to improve the binding with the structure in a desired portion of the latter; according to various embodiments, the fibers released are positioned in the form of a fan, some of the fibers are positioned going backwards relative to the direction they emerged in, they are positioned in the form of a spindle, they are positioned in the form of a "button"; this results in a local increase of the bonding surface area and/or the presence of a supplementary anchoring means; according to one embodiment, a portion of the structure is reinforced with two reinforcements of elongated shape that each comprise fibers released from their polymer matrix in one portion of each of the reinforcements and where the fibers of these reinforcement portions, released from their polymer matrix, are arranged by superposing them one on top of the other and they are bonded to the portion of the structure to be reinforced;
- the rearrangement of the fibers released from the polymer matrix consists in positioning these fibers in a cavity; the fibers may be bonded or sealed into the cavity; the cavity may be a through-cavity and it is possible to make the fibers pass through the cavity and to make them reemerge in order, for example, to then bond them; the through-cavity may, for example, be part of an anchoring element which is added onto the structure to be reinforced;
- the fibers of the reinforcement, released from the polymer matrix, are positioned in the form of a loop in a hole of an anchoring element.

According to one embodiment, the rearrangement of the fibers released from the polymer matrix of the reinforcement consists in positioning these fibers in a mold and in mixing them with a polymer matrix in order to form, by molding, a reinforcement portion of different shape to the initial shape of the reinforcement of elongated shape; a composite reinforcement portion is then reconstructed, having a shape different to the initial shape of the reinforcement. According to one example relating to this embodiment, the polymer matrix used for this molding is of similar or even identical composition to that of the initial polymer matrix of the reinforcement of elongated shape. This portion of the reinforcement may be bonded or sealed with the structure according to the desired configurations. According to various variants of this embodiment:

- the shape of the portion formed by molding has a more compact cross section than the initial cross section of the reinforcement of elongated shape;
- the portion formed by molding is inserted into a portion of the structure to be reinforced and bound to this portion of the structure;
- the binding of the portion formed by molding into the portion of the structure to be reinforced takes place according to one of the methods chosen from the list constituted of bonding, of pouring a mortar between the portion formed by molding and the portion of the structure in which it is inserted, of the insertion of the portion formed by molding during the fabrication, for example by pouring, of the portion of the structure to be reinforced;
- the shape of the portion formed by molding is more flared than the initial shape of the reinforcement of elongated shape; according to one embodiment, the flared part formed by molding is bonded to a portion of the structure to be reinforced.

The present invention also targets a construction structure reinforced by a reinforcement bonded to at least one portion of said structure wherein the reinforcement comprises a portion of elongated shape comprising continuous fibers in the longitudinal direction of said reinforcement, combined with a polymer matrix, and a portion where fibers in continuity of material with the fibers of the portion of elongated shape are arranged in a different geometry from the fibers of the portion of elongated shape, for example bonded directly to a portion of the construction structure or, for example, positioned in a polymer matrix along a cross section different from that of the portion of elongated shape.

It goes without saying that all the features described above in relation to the process according to the invention find their application in the structure according to the invention and may be combined in order to illustrate various embodiments of a structure according to the invention.

BRIEF DESCRIPTION OF THE DRAWINGS

Other particularities and advantages of the present invention will appear from the description below of non-limiting exemplary embodiments, with reference to the appended drawings in which:

FIGS. 2 to 6 illustrate various arrangements according to the invention, of fibers released from the polymer matrix and bonded to a portion of a structure to be reinforced;

FIGS. 8 to 10 illustrate various reinforcements obtained according to the invention comprising a molded reinforcement portion;

FIG. 11 illustrates one mode of reinforcing a structure.

For reasons of clarity, the dimensions of the various elements represented in these figures are not necessarily in proportion to their actual dimensions. In these figures, identical references correspond to identical elements.

DESCRIPTION OF PREFERRED EMBODIMENTS

Figure 1:
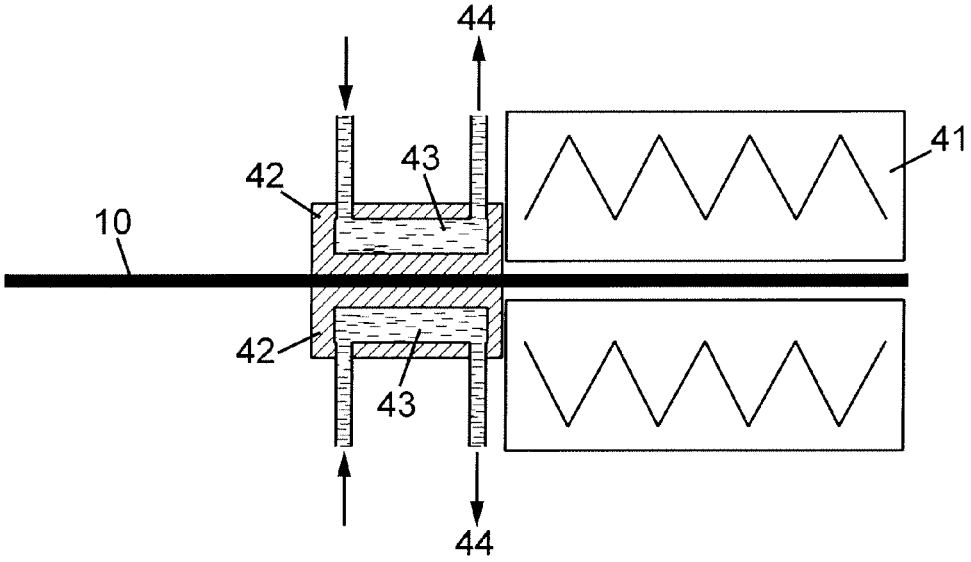
FIG. 1 represents a schematic view of a device for removing the polymer matrix from a reinforcement of elongated shape.

FIG. 1 represents a schematic view of a device for reducing the polymer matrix of a reinforcement of elongated shape 10, for example in lamellar form. The latter is introduced into a furnace 41 brought to a temperature suitable for leading to the pyrolysis of the polymer matrix of the reinforcement 10 while preserving the continuous fibers which are part of this reinforcement. In order to limit the zone of the reinforcement where the polymer matrix is removed, cooled parts 42 contact the reinforcement 10 near the furnace 41 and thus prevent the heat from transferring beyond a desired zone. The cooled parts 42 comprise, for example, cavities 43 in which a cold fluid 44 flows.

After having removed the polymer matrix with the above device, or any other suitable method, the fibers are rearranged in order to optimize the binding of the reinforcement 10 with a portion of the structure to be reinforced (not represented as such).

Figure 2:
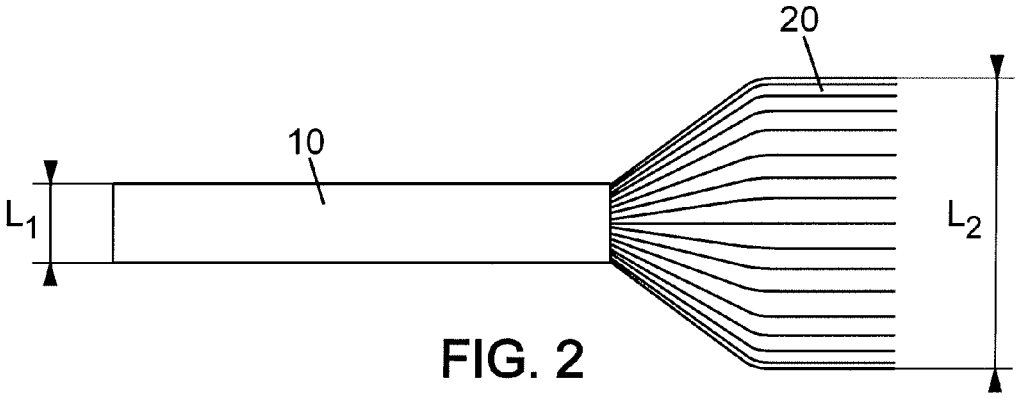

According to the embodiment from FIG. 2, the reinforcement 10 in the lamellar form has an initial width $L_1$. The fibers are released from the polymer matrix in a zone 20 located at one end of the reinforcement 10 and positioned substantially in a fan so as to make it possible to obtain a great expansion of the fibers and a greater contact area for one and the same length as with the initial reinforcement in lamellar form. The width $L_2$ over which the fibers released from the matrix may extend may be, for example, five to ten times greater than $L_1$. The fibers released from the matrix are bonded to a portion of the structure to be reinforced.

Figure 3:
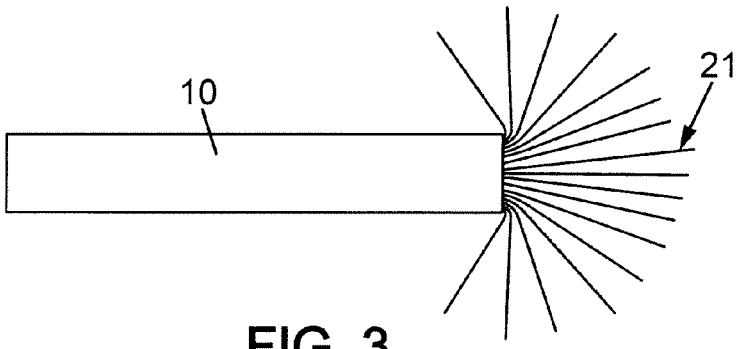

According to one variant represented in FIG. 3, the fibers released from the matrix are positioned in a zone 21, partly backwards with respect to the direction from which they emerge from the reinforcement in lamellar form where the matrix is retained.

According to another variant, represented in FIG. 4, the reinforcement of elongated shape is a rod of circular cross section. The fibers are released from the matrix in one reinforcement zone located between two ends of this reinforcement and in one other, a reinforcement zone located at the end of said reinforcement. The fibers released between two ends are between an upstream portion 31 and a downstream portion 32 of the rod. The fibers released at the end are located beyond the downstream portion 32 of the rod. These fibers are rearranged in the form of "buttons" 35, 36. The button 35 is formed by bringing the upstream portion 31 and downstream portion 32 closer together so as to form, for example, a ball or a flat cylinder. The button 36 is formed by rearranging the fibers released in the form of a ball or of a flat cylinder. It is noted that the fibers in zones 35, 36 could also adopt the shape of a spindle.

According to another variant, represented in FIGS. 5*a* and 5*b*, a reinforcement in lamellar form is positioned on a structure 45. The fibers of this reinforcement are released from the polymer matrix in a zone 22, located between an upstream reinforcement portion 11 and a downstream reinforcement portion 12. These reinforcement portions may be bonded to the surface of the structure 45.

The fibers from zone 22 are arranged as a spindle at the surface of the structure 45. A hole 46 is made in the structure 45 so as to receive a rod 41. The rod 41 may be held in the hole 46 by bonding, by introduction of a grout or any other suitable means.

The rod 41 is introduced into the hole 46 after having passed through the spindle-shaped fibers 22 of the reinforcement in lamellar form.

The fibers located at one end of this rod 41 are previously released from the polymer matrix.

These fibers 42, located at one end of the polymer rod opposite the end of the rod which is placed in the hole 46, are then positioned on top of the fibers 22 of the reinforcement in lamellar form. The fibers 22 and 42 are then firmly attached together, for example by bonding. It goes without saying that the fibers 42 may extend beyond the fibers 22, and be positioned, for example, on the upstream portion 11 and downstream portion 12 of the reinforcement in lamellar form, and also at the surface of the structure 45.

Figure 6:
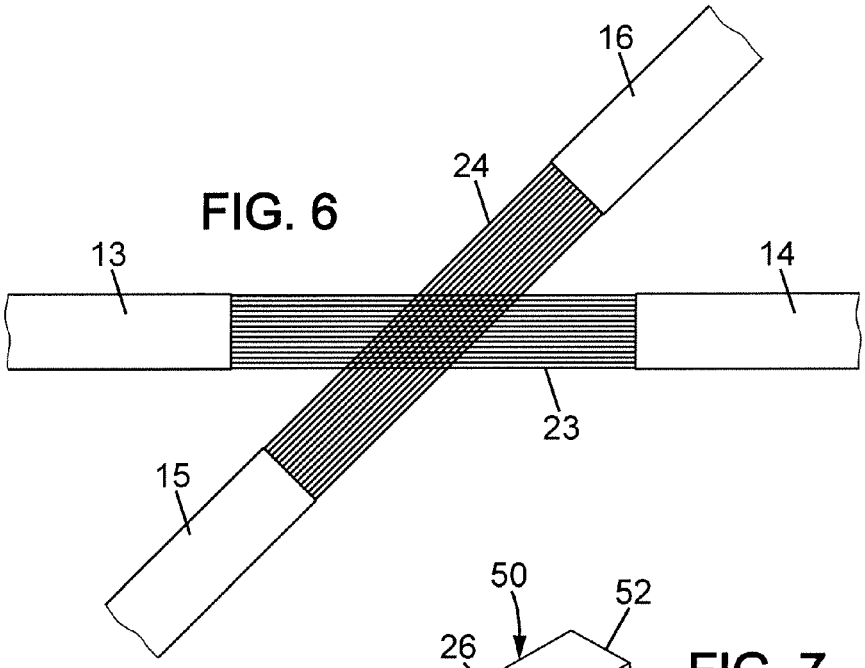

According to another variant represented in FIG. 6, two reinforcement zones 23, 24 where the fibers are released from their polymer matrix and located respectively between two ends 13, 14 and 15, 16 of these two reinforcements, are superposed. The released and superposed fibers are bonded to a portion of the structure to be reinforced thus making it possible to increase the strength of the bond in the crossover zone of the two reinforcements.

Tests have been carried out in accordance with one embodiment where use is made of a reinforcement in lamellar form of the FOREVA® LFC type, of width $L_1$=50 mm, having a thickness of 1.2 mm and that is constituted of carbon fibers and of epoxy resin. It is determined that such a reinforcement makes it possible to take up a load over one portion of a concrete structure of the order of 2.5 tonnes when it is bonded to concrete over a length of 100 mm. It is determined that the bonding of a reinforcement to a portion of concrete structure, as illustrated in FIG. 2, where the fibers have been released from the matrix over a length of 100 mm and where $L_2=2L_1$, makes it possible to substantially double the load taken up by the reinforcement.

According to other embodiments, illustrated in FIGS. 7 to 10, the rearrangement of the fibers released from the polymer matrix of the reinforcement consists in positioning these fibers in a mold and in mixing them with a polymer matrix in order to form, by molding, a reinforcement portion 25, 26, 27, 28, 29 having a shape different from the initial shape of the reinforcement of elongated shape, for example in lamellar form, 17, 18, 19. It is also possible to envision forming a reinforcement portion by mixing fibers released from the initial polymer matrix with a polymer matrix by any other forming method, other than molding, suitable for the manufacture or a composite portion, such as for example extrusion or pultrusion.

Figure 7:
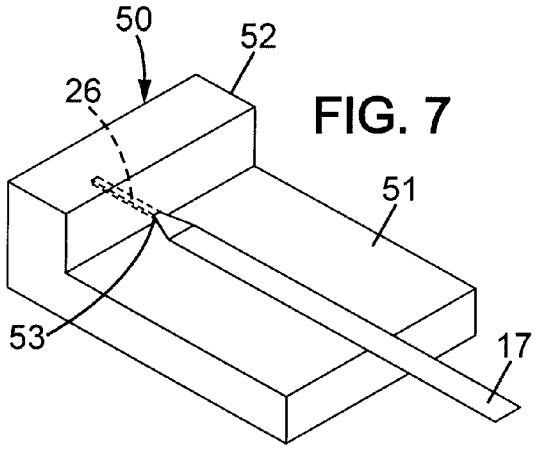
FIG. 7 represents a schematic view of a device for molding a portion of reinforcement according to the invention.

FIG. 7 represents a schematic view of a molding device 50 comprising a portion 51 that makes it possible to support a reinforcement in lamellar form 17 and a portion 52 comprising a cavity 53 into which the fibers of said reinforcement, previously released from the polymer matrix, are introduced. These fibers are placed in the cavity 53 and mixed with a polymer resin, for example having a composition similar to that of the polymer matrix of the reinforcement.

In the example represented, the cavity 53 is of substantially rectangular cross section; generally, its cross section and its shape are chosen so as to obtain the desired shape of the reinforcement portion having a shape different from the initial shape of the reinforcement of elongated shape.

Figure 8:
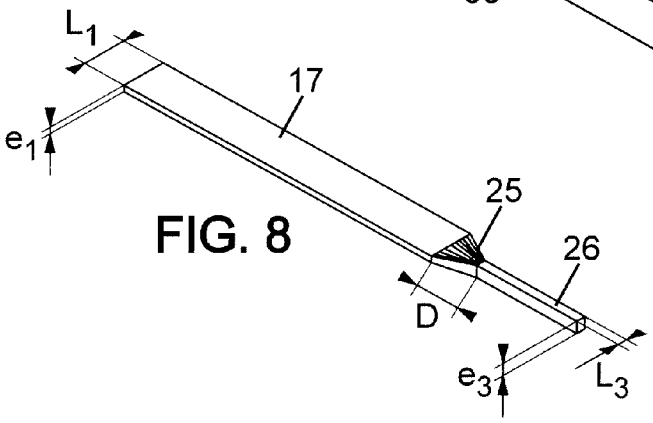

After molding with the device 50, a reinforcement is obtained, represented in FIG. 8, comprising a portion in lamellar form having a width $L_1$ and a thickness $e_1$, and an intermediate zone 25 of length D where the fibers converge toward a parallelepipedal portion 26 of width $L_3$ and of thickness $e_3$. In this embodiment, $L_3$ is substantially equal to $e_3$.

The parallelepipedal portion 26 may advantageously then be placed in a cavity of the structure to be reinforced and be sealed therein, for example by bonding or by introduction of a mortar. The portion 17 in lamellar form may be bonded to another portion of the structure to be reinforced.

Figure 9:
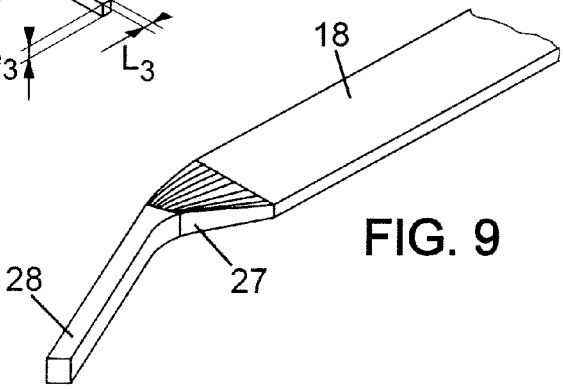

According to a variant represented in FIG. 9, the parallelepipedal portion 28 is inclined in a plane different from that of the portion 18 in lamellar form. It is thus advantageously possible to anchor this parallelepipedal portion 28 in a cavity inclined relative to an axis of reinforcement, so as, for example, to reinforce a beam over its length.

According to another embodiment represented in FIG. 10, the fibers previously released from the polymer matrix have been placed in a mold comprising a trapezoidal cavity that makes it possible to obtain a portion 29 where the fibers spread out in a direction perpendicular to the longitudinal direction so that this portion 29 is flatter and wider than the portion 19 in lamellar form. By way of example, the maximum width $L_4$ of this portion 29 is around two times greater than the width $L_1$ of the portion in lamellar form and its minimum thickness $e_4$ is two times smaller than the thickness $e_1$ of the portion in lamellar form. Such a widened portion 29 may be bonded to a portion of the structure to be reinforced so as to increase the load uptake in this portion of the structure.

It goes without saying that similar rearrangements may be obtained with reinforcements in rod form, or that have any other elongated shape. FIG. 11 illustrates a schematic view of a method of reinforcement of a construction structure.

The structure comprises a buried portion 60 constituted of a foundation footing surmounted by a semi-buried wall 62. A slab 63 is attached to the wall 62. The wall 62 is surmounted by a wall 61 which emerges from the ground. By way of example, the foundation footing, the semi-buried wall and the slab are made of reinforced concrete and the wall 61 is made of masonry.

A vertical axis has been represented as a dotted line. By convention, it is said that this line limits the outer face of the walls 62 and 61 and that the opposite face of these walls is an internal face.

In the structure represented, the level of the slab 63 is below the external level of the ground so much so that the face 67 of the semi-buried wall 62 is accessible whereas the opposite face of this wall is buried. The portion of the semi-buried wall 62 located underneath the level of the slab 63 is completely buried, as is the foundation footing.

In order to reinforce this structure, a cavity 64 has been hollowed out at a slant in the wall 62 and the foundation footing. In the example represented, the cavity 64 is substantially cylindrical and may measure several meters in length and have a diameter of around a few tens of centimeters.

Placed in the cavity 64 next is an anchoring element 70 which comprises one end 71 through which rovings of reinforcing yarns may be threaded. The anchoring element 70 is sealed, for example with a grout of cement or mortar, or concrete by filling the cavity 64. A reinforcement of elongated shape 80 is placed on the internal face 66 of the wall 61 and the internal face of the wall 62. This reinforcement may be in lamellar form. It may comprise unidirectional fibers or a woven fabric of fibers.

The fibers of this reinforcement are previously released from their polymer matrix at one end, situated beyond the zone 81. They are then positioned so that one portion of the fibers forms a roving. This roving is threaded into the end 71 of the anchoring element 70 before the latter is completely positioned in the cavity 64, and therefore before it is sealed. The roving of reinforcing yarns forms a loop that passes through said cavity 64 and the roving reemerges from the cavity 64. After positioning then sealing of the anchoring element 70 in the cavity 64, the roving of reinforcing yarns is positioned, for example as a fan at the internal surface 67 of the wall 62 and/or on the reinforcement 80. The yarns thus positioned are firmly attached, for example by bonding to the structure. The embodiments described in the patent application published under the reference FR 2 918 689 can be used within the context of the present invention, where a reinforcement of elongated shape is positioned on a portion of a structure and where a roving of reinforcing yarns is formed from said reinforcement by release from the polymer matrix.

It is thus possible to use the process according to the invention for reinforcing construction structures according to numerous configurations.

The invention is not limited to the embodiment types exemplified and should be interpreted in a manner that is nonlimiting and that encompasses any equivalent embodiment.

What is claimed is:

1. A method for reinforcing a construction structure, the method comprising:

providing a reinforcement of elongated shape laid on a surface of said structure, said reinforcement comprising continuous fibers in a longitudinal direction of said reinforcement, said fibers being combined with a polymer matrix;

removing the polymer matrix in at least one portion of the reinforcement;

releasing the fibers in said at least one portion of the reinforcement from the polymer matrix;

rearranging the released fibers of said at least one portion of the reinforcement; and bonding the rearranged and released fibers of said at least one portion of the reinforcement directly onto a portion of the surface of the structure to be reinforced, wherein the surface of the structure is reinforced with two reinforcements that each comprise fibers released from their polymer matrix in respective portions of the two reinforcements, and wherein rearranging the released fibers of said portions of the reinforcements comprises superposing said portions one on top of the other for bonding the fibers of said portions directly to the surface of the structure to be reinforced.

2. The method of claim 1, wherein the polymer matrix comprises a thermosetting polymer, and removing the polymer matrix comprises a pyrolysis of the polymer matrix.

3. The method of claim 2, wherein removing the polymer matrix comprises cooling another portion of the reinforcement so as to limit transfer of heat due to the pyrolysis.

4. The method of claim 1, wherein the reinforcement of elongated shape is one of a reinforcement in lamellar form, a reinforcement in rod form, a pultruded elongated reinforcement, and an extruded elongated reinforcement.

5. The method of claim 1, wherein a portion of the reinforcement where the polymer matrix has been removed is located at one end of said reinforcement.

6. The method of claim 1, wherein at least one portion of the reinforcement where the polymer matrix has been removed is located between the ends of said reinforcement.

7. The method of claim 1, wherein rearranging the released fibers of the reinforcement comprises disposing said fibers according to a geometric shape different from a geometric shape they had in the reinforcement.

* * * * *